US005754197A

United States Patent [19]

Shibata

[11] Patent Number: 5,754,197

[45] **Date of Patent: *May 19, 1998**

[54] CLEANER CARTRIDGE FOR AN INKJET PRINTING MECHANISM

[75] Inventor: Alan Shibata, Camas, Wash.

[73] Assignee: Hewlett-Packard Company, Palo Alto, Calif.

[ * ] Notice: The term of this patent shall not extend beyond the expiration date of Pat. No. 5,589,861.

[21] Appl. No.: 713,573

[22] Filed: Sep. 18, 1996

Related U.S. Application Data

[63] Continuation of Ser. No. 250,899, May 31, 1994, Pat. No. 5,589,861.

[51] Int. Cl.[6] ..... B41J 2/165

[52] U.S. Cl. ..... 347/22; 347/33; 347/87

[58] Field of Search ..... 347/22, 28, 30, 347/31, 33, 87, 93

[56] References Cited

U.S. PATENT DOCUMENTS

| | | | |
|---|---|---|---|
| 5,300,958 | 4/1994 | Burke et al. | 347/33 X |
| 5,500,659 | 3/1996 | Curran, Jr. et al. | 347/30 X |
| 5,517,221 | 5/1996 | Nguyen | 347/36 X |
| 5,589,861 | 12/1996 | Shibata | 347/22 |
| 5,589,865 | 12/1996 | Beeson | 347/28 |

*Primary Examiner*—John E. Barlow, Jr.
*Attorney, Agent, or Firm*—Flory L. Martin

[57] ABSTRACT

A cleaner or replenishing cartridge and a method of cleaning an inkjet printing mechanism using such a cartridge is disclosed. An inkjet pen within the printing mechanism is replaced by cleaner cartridge which is then positioned over or adjacent to a location of the printing mechanism to be cleaned. Power is applied to the cartridge either by coupling an on-board battery via a signal from the carriage interconnect, or through pulses applied through the interconnect. The cartridge may be fashioned for dispensing a fluid, such as an ink solvent, a lubricant, or a staticide to various printer components. The fluid may also be supplied to replenish a printer reservoir. The cartridge may be used for extracting ink sludge from the printer's ink lines, or for applying a vacuum suction force to draw particles into the cartridge. The cartridge may propel a strip of cleaning media across an area to be cleaned, or refurbish worn printhead wipers. By removing various accumulations of dirt, grit, and solidified ink from the printer, print quality may be improved and operation of the printer restored to a near-new condition.

17 Claims, 9 Drawing Sheets

CLEANER CARTRIDGE FOR AN INKJET PRINTING MECHANISM

This is a continuation of application Ser. No. 08/250,899 filed on May 31, 1994 now U.S. Pat. No. 5,589,961.

FIELD OF THE INVENTION

This invention relates generally to a cleaner cartridge for an inkjet printing mechanism, and more particularly to a cleaning cartridge device and a method for periodically servicing an inkjet printing mechanism, such as an inkjet printer or plotter, by performing a maintenance task.

BACKGROUND OF THE INVENTION

Inkjet printers use pens which shoot drops of ink onto a page. Each pen has a printhead formed with very small nozzles through which the ink drops are fired. To print an image, the printhead moves back and forth across the page shooting drops as it moves. Inkjet printing mechanisms may be included in a variety of different devices, such as inkjet printers, plotters, scanners, facsimile machines, or other devices, all of which are referred to collectively herein as "inkjet printers." The print medium is typically a sheet material, such as paper, mylar, foils, transparencies, card stock, etc., but for convenience the term "paper" is used herein for purposes of illustration.

During the life of an inkjet printing mechanism, various components of the mechanism become dirty, or require some type of recharging, replenishing or resurfacing to return the printer to optimum levels of performance comparable to its performance when new. Other types of devices have used cleaner cartridges for periodic servicing or maintenance. For example, video recorders and audio tape recorders use head cleaner cartridges, which are inserted into the recorder in the location normally occupied by the tape cassette. These recorder cleaner cartridges have been used in combination with a pad and solvent for physically wiping the recording heads, and in other versions to demagnetize the printheads. These audio and video recorder cleaner cartridges are widely accepted and appreciated by consumers. The inventor is unaware of anyone attempting to address long-term consumer cleaning and maintenance of an inkjet printing mechanism using a cleaner cartridge approach.

Thus, a need exists for a cleaner cartridge for use with an inkjet printing mechanism to optimize print quality and extend the life of the printing mechanism.

SUMMARY OF THE INVENTION

According to one aspect of the present invention, a cleaner cartridge is provided for servicing an inkjet printing mechanism having a pen carriage. The cartridge includes a body configured to be removably received in the pen carriage. The cartridge also has a mechanism housed in the body and configured to perform a maintenance task on one or more components of the inkjet printing mechanism.

According to another aspect of the present invention, a method is provided for periodically servicing and/or replenishing various components of an inkjet printing mechanism having a pen carriage. The method includes the steps of replacing an inkjet pen within the printing mechanism with a cleaner cartridge, and positioning the cleaner cartridge over a component of the printing mechanism to be serviced. In a performing step, a maintenance task is performed on the component using the cleaner cartridge.

An overall goal of the present invention is to provide a cleaner cartridge for cleaning and/or servicing and refurbishing various components of the inkjet printing mechanism.

Another goal of the present invention is to provide a printer cleaner or servicing cartridge for an inkjet printing mechanism which may be used to optimize print quality and/or extend the life of an inkjet printing mechanism.

A further goal of the present invention is to provide a method by which a consumer may periodically service and/or replenish components and/or consumables within an inkjet printing mechanism.

DETAILED DESCRIPTION OF THE PREFERRED EMBODIMENTS

Figure 1:
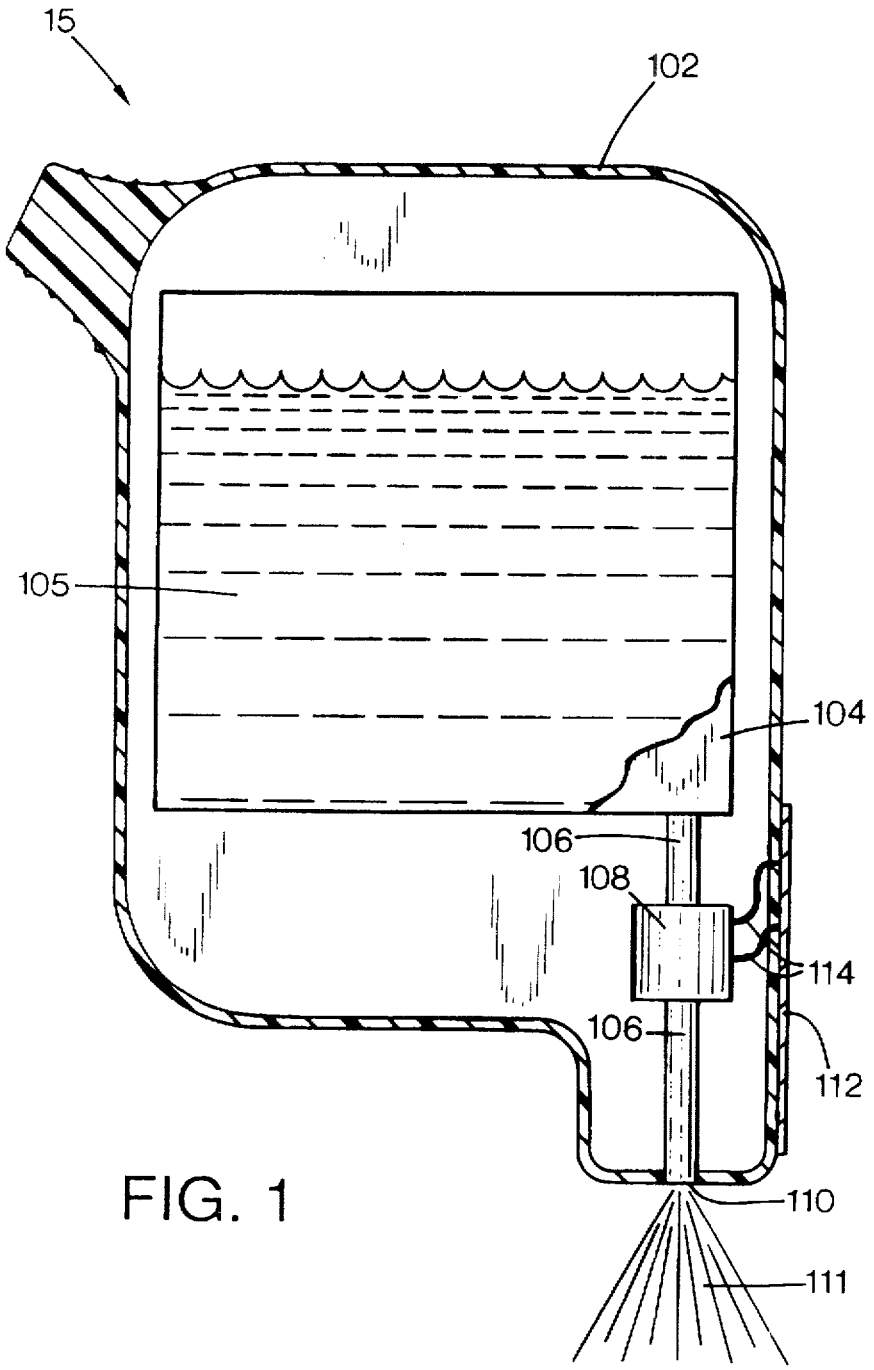
FIG. 1 is a sectional side elevational view of a first embodiment of an inkjet cleaner cartridge of the present invention.
Figure 2:
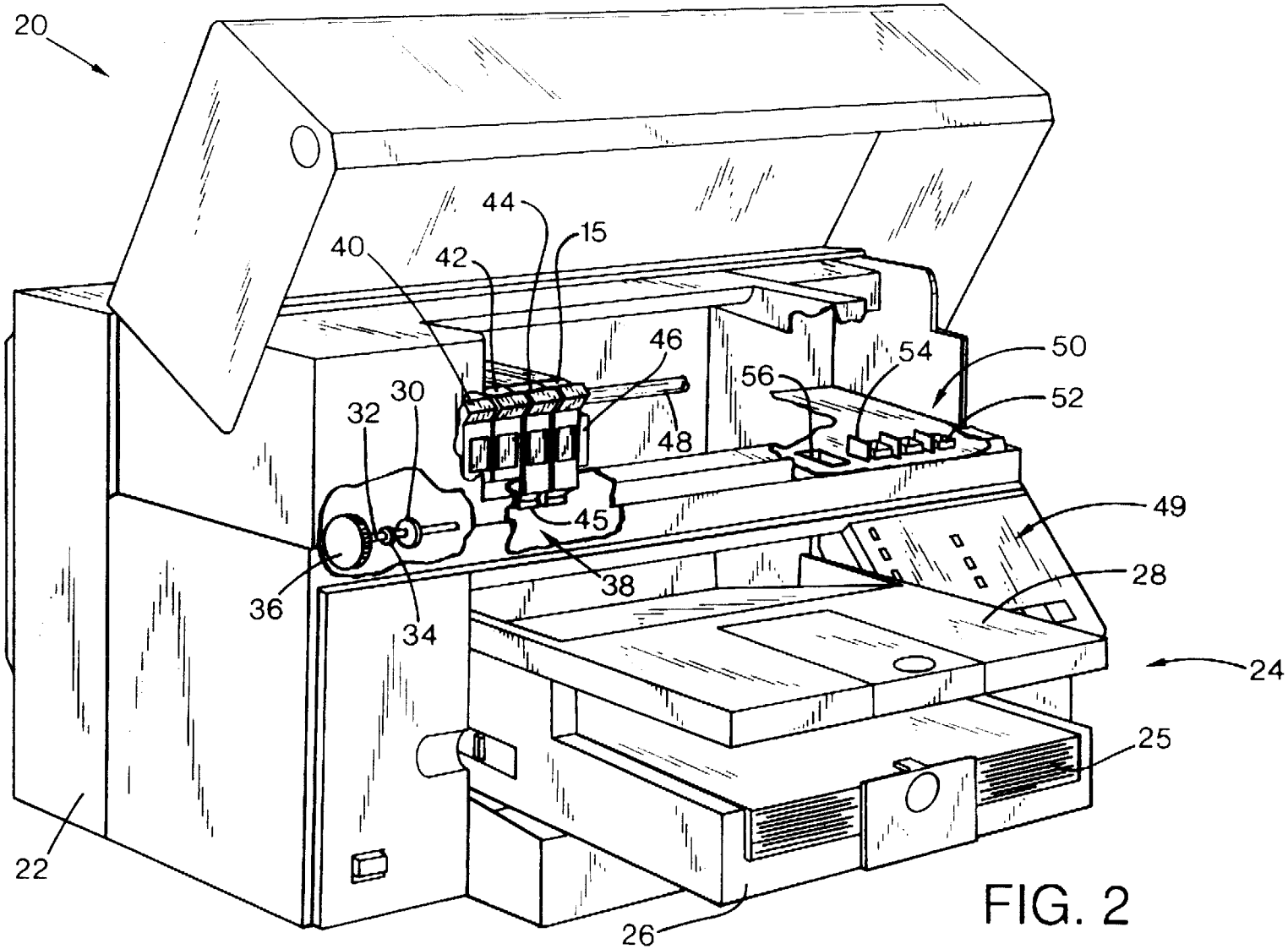
FIG. 2 is a perspective view of a first embodiment of an inkjet printing mechanism used to illustrate several operational characteristics of the illustrated forms of the inkjet cleaner cartridge of the present invention.

FIG. 1 illustrates an embodiment of a cleaner cartridge 15 constructed in accordance with the present invention which may be used to perform a maintenance task, including cleaning, servicing, refurbishing various components, and/or replenishing consumables of an inkjet printing mechanism, such as an inkjet printer, plotter, facsimile machine or the like, illustrated in FIG. 2 as an inkjet printer 20. While several printing mechanisms will be described herein to illustrate the operational features of various embodiments of the cleaner cartridge, the first printer 20 includes a chassis 22, and a print medium handling system 24 for supplying a print medium 25 to the printer 20. The print medium 25 may be any type of suitable sheet material, such as paper, card-stock, transparencies, mylar, foils, and the like, but for convenience, the illustrated embodiment is described using paper as the print medium. The print medium handling system 24 includes a feed tray 26, an output tray 28, and a series of media feed rollers, such as roller 30. The feed rollers 30 are mounted on a shaft 32 supported by a pair of bearings, such as bearing 34. The roller shaft 32 may be driven via a drive gear 36 coupled to a conventional motor (not shown).

The feed rollers 30 cooperate to deliver the sheets of paper 25 from the feed tray 26 into position at a print zone 38 for receiving ink from one or more inkjet pens or cartridges, such as a black ink cartridge 40 and/or a cyan, magenta or yellow color ink cartridge, such as cartridges 42, 44. In FIG. 2, one of the color pens has been replaced with the cleaner cartridge 15 or alternate embodiments discussed further below. The illustrated pens 40–44 each include internal reservoirs for storing a supply of ink therein, and have printheads, such a printhead 45 of pen 44. Each printhead 45 has a bottom surface comprising an orifice plate (not shown) with a plurality of nozzles formed therethrough in a manner well known to those skilled in the art. Typically, the printheads 45 are thermal inkjet printheads, although other types of printheads may be used, such as piezoelectric printheads. The printheads 45 typically includes a plurality of resistors (not shown) which are associated with the nozzles. Upon energizing a selected resistor, a bubble of ink is formed and then ejected from the nozzle and on to a page 25 in the print zone 38 under the nozzle.

The pens 40–44 are transported by a carriage 46 which may be driven along a guide rod 48 by a conventional drive belt/pulley and motor arrangement (not shown). The pens 40–44 selectively deposit one or more ink droplets on a sheet 25 in accordance with instructions received from a printer controller, such as a microprocessor (not shown), located within chassis 22. The controller generally receives instructions from a computer (not shown), such as a personal computer. The printhead 48, as well as the carriage motor (not shown) and paper handling system drive motor (not shown) each operate in response to the printer controller, which may operate manner well known to those skilled in the art. The printer controller also operates in response to user inputs provided through a key pad 49. A monitor (not shown) coupled to the computer may be used to display visual information to an operator, such as the printer status or a particular program being run on the computer. Personal computers, their input devices, such as a keyboard and/or a mouse device (not shown), and monitors are all well known to those skilled in the art.

The printer 20 may include a conventional service station assembly 50 having a platform upon which may be mounted conventional inkjet pen caps, such as cap 52. The platform may also support conventional color and black ink wipers, such as the ink wiper 54 for wiping the printheads 45 of the pens 40–44. The service station 50 may also include a spittoon 56 within which the pens 40–44 may periodically purge unused nozzles by firing ink droplets into the spittoon 56.

Now the operation of printer 20 is better understood, the cleaner cartridge 15 shown in FIG. 1 will be described in greater detail. Preferably, the cartridge 50 has a casing or body 102 approximating generally the same size, dimensions, and at least some of the same external physical interconnections as the pens 40–44. In this manner, the cartridge 50 may be received in the carriage 46 in place of the one of the pens. Enclosed within the casing 102 is a reservoir 104 filled with a fluid 105. A conduit 106 provides a fluid passageway from the reservoir 104 through a metering unit 108 to an exit nozzle 110. The illustrated nozzle 110 dispenses the fluid 105 in a spray pattern 111, although it is apparent that nozzle I 10 may also dispense the fluid 105 in a direct stream (not shown). The metering unit 108 may be a conventional or other pump or valve, which is preferably powered to operate by interconnect pulses received through a flextab circuit 112 via conductors 114.

The flex circuit 112 may be of the same general configuration as the conventional flextab circuit on one of the pens 40-44. For example, while the conventional flextab circuit on a pen has multiple conductor pads for separately powering each of the resistors associated with multiple pen nozzles, only two or a few parallel pads may be required to power the cartridge 15. Moreover, the flextab pads may also be used to provide any separate control signals to control other functions that may be incorporated within embodiments of the cleaner cartridge. The cartridge 15 may receive such power and/or control signals from the interconnect circuit (not shown) on the carriage 46.

The fluid 105 is preferably a liquid, and the structure of cartridge 15 may be used to implement several embodiments, depending upon the type of fluid 105, nozzle 110, and the area within printer 20 where the liquid is dispensed. For example, the liquid 105 may be a solvent to dissolve ink crystals which have formed or collected over time on the various printer components. The liquid 105 may be dispensed in a spray pattern 111 to clean the pen caps 52, the wipers 54, and/or the service station platform upon which they are mounted. By selecting the fluid 105 to be an ink crystal solvent, the cleaner cartridge 15 may be positioned over the spittoon 56 and powered to inject fluid into the spittoon to reduce the volume of ink solids accumulated therein.

In another embodiment, the fluid 105 may be a lubricant, such as a grease or oil for lubricating various moving parts within the printer 20. For example, the cartridge 15 may dispense the lubricant 105 to the bearings 34 on the paper feed drive shaft 32, or to the drive gear 36.

Figure 3:
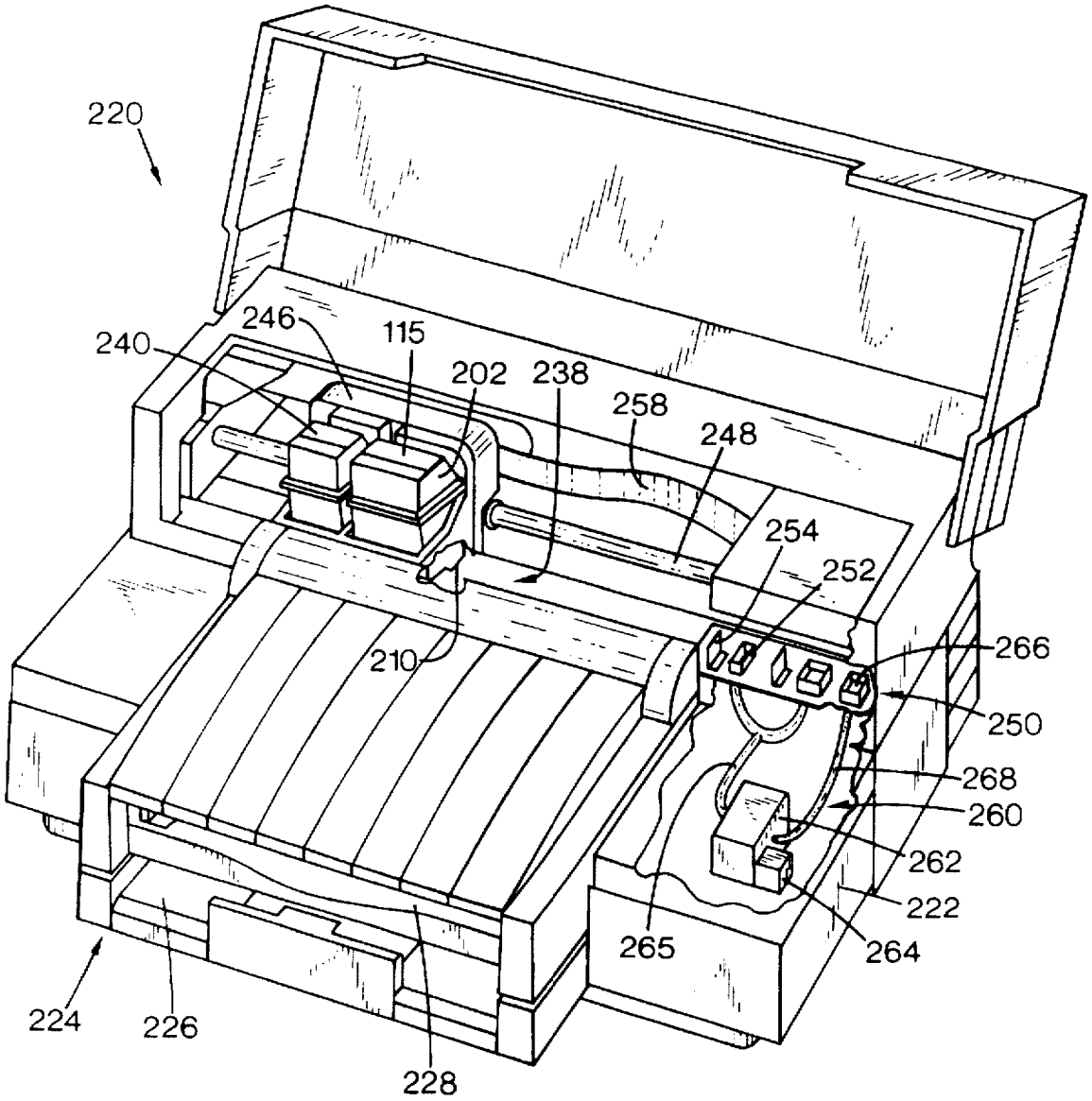
FIG. 3 is a perspective view of a second embodiment of an inkjet printing mechanism used to illustrate several operational characteristics of the illustrated forms of the inkjet cleaner cartridge of the present invention.

It is apparent that the reservoir 104, conduit 106, metering unit 108 and nozzle 110 may be housed in other forms of a pen casing other than body 102 shown in FIG. 1. For example, FIG. 3 shows a cleaner cartridge 115 constructed in accordance with the present invention. The cartridge 115 has another style of casing or body 202 structured to dispense the fluid, such as fluid 105 in FIG. 1, through a nozzle or group of nozzles 210. The cartridge 115 is installed in place of a color pen of an inkjet printer 220. The various components of printer 220 which have functions analogous to those described for printer 20 have item numbers increased by 200 over those shown in FIG. 2. For example, in FIG. 2 the printer carriage is assigned item number 46, whereas in FIG. 3, the carriage is assigned item number 246. FIG. 3 also illustrates a flexible strip conduit 258, which was omitted for clarity in FIG. 2. The flex strip 258 delivers a set of control signals to interconnects on the carriage 246 which provide control signals to the ink pens, such as pen 240 to regulate firing of the nozzles. When using the cleaner cartridge 115, the flex strip 258 provides control and power signals to the cartridge.

In a further embodiment, the cleaner cartridge 115 may be filled with a staticide fluid to reduce static in the printer 220. Static build up within the printer components attracts dust, paper particles, and other grit, which may degrade print quality. The staticide fluid may be dispensed in as a spray, such as pattern 111 in FIG. 1, along the various printer components. For example, the staticide may be sprayed in the general location of the print zone 238, and/or in the area of the service station 250.

As the search continues to increase the print quality of inkjet printing mechanisms, newer inks are continually being developed. One of the latest series of coloring agents or inks used in thermal inkjet technology has a higher solid content than previous formulations. To effectively wipe the nozzles of the inkjet pens, such as the black ink pen 240 in FIG. 3, various schemes have been proposed to apply a small amount of solvent to the nozzle plate face to facilitate wiping. A typical solvent dispensing system 260 may include a solvent reservoir 262. The solvent may be periodically dispensed from reservoir 262 through capillary action, or through the use of a pump or other actuator, such as a piston actuator 264, through conduit 265 to the service station 250. The solvent from conduit 265 may be applied in the general vicinity of the wipers 254 to facilitate a wet wiping of the printheads.

During the life of printer 220, it may be desirable to refill the solvent reservoir 262. This refilling may be accomplished using cartridge 115 as a replenishing cartridge filled solvent. The printer 220 may be equipped with an inlet port 266 coupled to the reservoir 262 by provide a fluid passageway, such as tubing, or other conduit 268. The replenishing cartridge 115 may be positioned with the nozzle 210 over the inlet port 266, and then powered to dispense the solvent in a stream into the inlet port 266 to refill reservoir 262.

Figure 4:
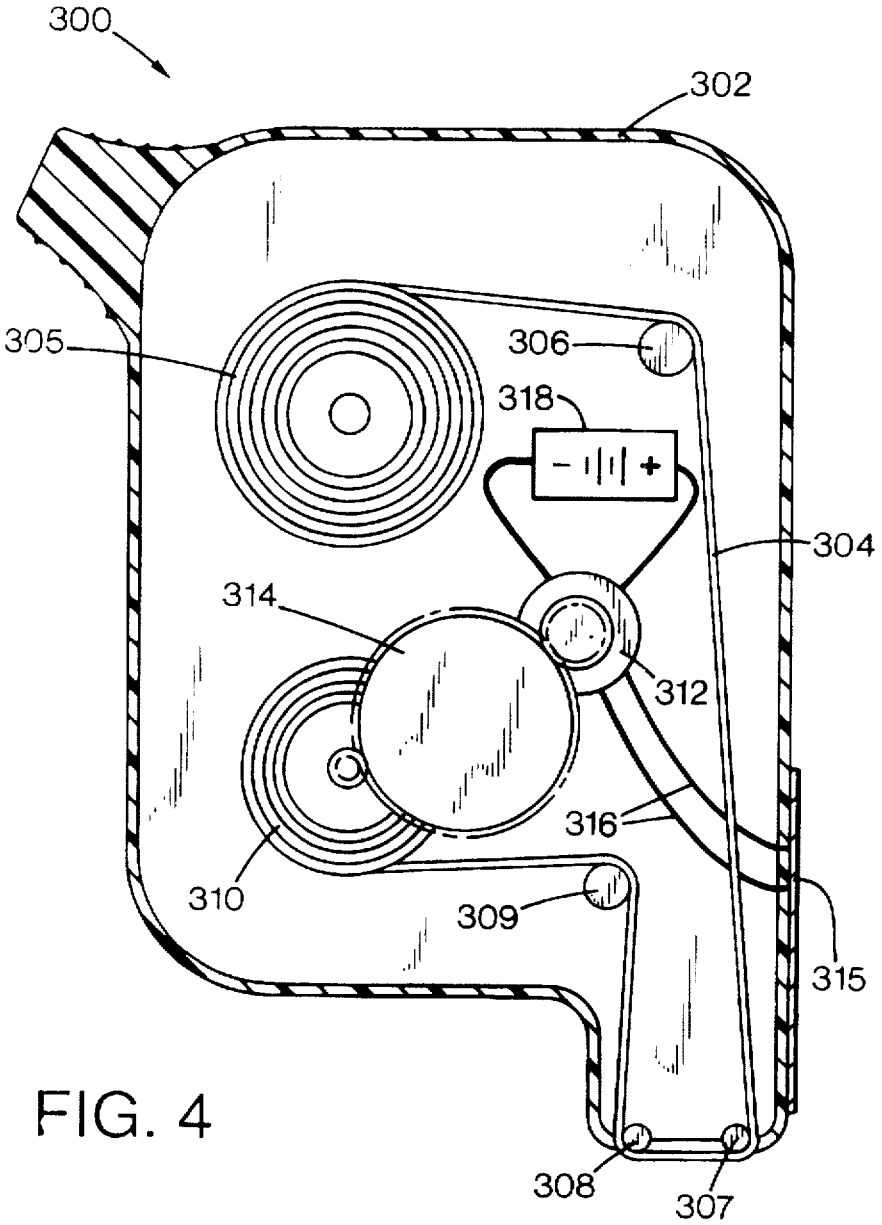
FIG. 4 is a sectional side elevational view of a second embodiment of an inkjet cleaner cartridge of the present invention.

FIG. 4 shows another embodiment of a cleaner cartridge 300 constructed in accordance with the present invention which has a body 302 suitable for use in the style of printer 20 shown in FIG. 2. It is apparent from the example given above with respect to FIGS. I and 3, that the casing 302, as well as the other casing embodiments described further below, may also take the form of body 202, or other designs suitable to be received within the carriage of the particular style of printer being serviced.

Rather than using a fluid as the cleaning media as described above with respect to cartridges 15 and 115, the cartridge 300 uses a cleaning media strip 304. The media strip 304 may be of an abrasive material, such as a sandpaper or other grit or abrasive surface. Alternatively, the media strip 304 may be of an absorbent material such as a tissue, or other liquid absorbing material. The media strip 304 may also be of a particle attracting material, or a fabric or paper material treated with a article attracting compound.

The cleaner media 304 may be dispensed from a feed reel 305 across one or more guide pins or guide rollers 306, 307, 308 and 309, to a take-up or collection reel 310. In the illustrated embodiment, the take-up reel 310 is driven by a motor 312 via a drive gear 314, although other structurally equivalent drive linkage mechanisms may be used, such as a drive belt (not shown). The motor 312 may receive power from the flextab circuit interconnect 315 via conductors 316. Alternatively, the motor 312 may be powered by an on-board battery 318 which is controlled via signals received through the flex strip 315.

Between the guide rollers 307 and 308, sections of the cleaner media 304 are exposed to clean various components of the printer 20. For example, using either an abrasive media, an absorbent media or an alternating combination of abrasive and absorbent areas, the cartridge 300 may be positioned by carriage 46 to clean the wipers 54, the caps 52, or various other components in the print zone 38. Alternatively, the cleaner media 304 may have a soft texture and be enhanced with a particle attractant material to attract various paper particles, dust and the like from components within the print zone 38. The media strip 304 may also be a combination of these various types of materials, such as a first portion being a grit abrasive for cleaning the caps and wipers, another portion being enhanced with a particle attractant to clean dust generated during the abrasive cleaning process. Another portion of such a combination media may be a soft and/or absorbent tissue-like material for buffing the printer components as a final cleaning step.

Figure 5:
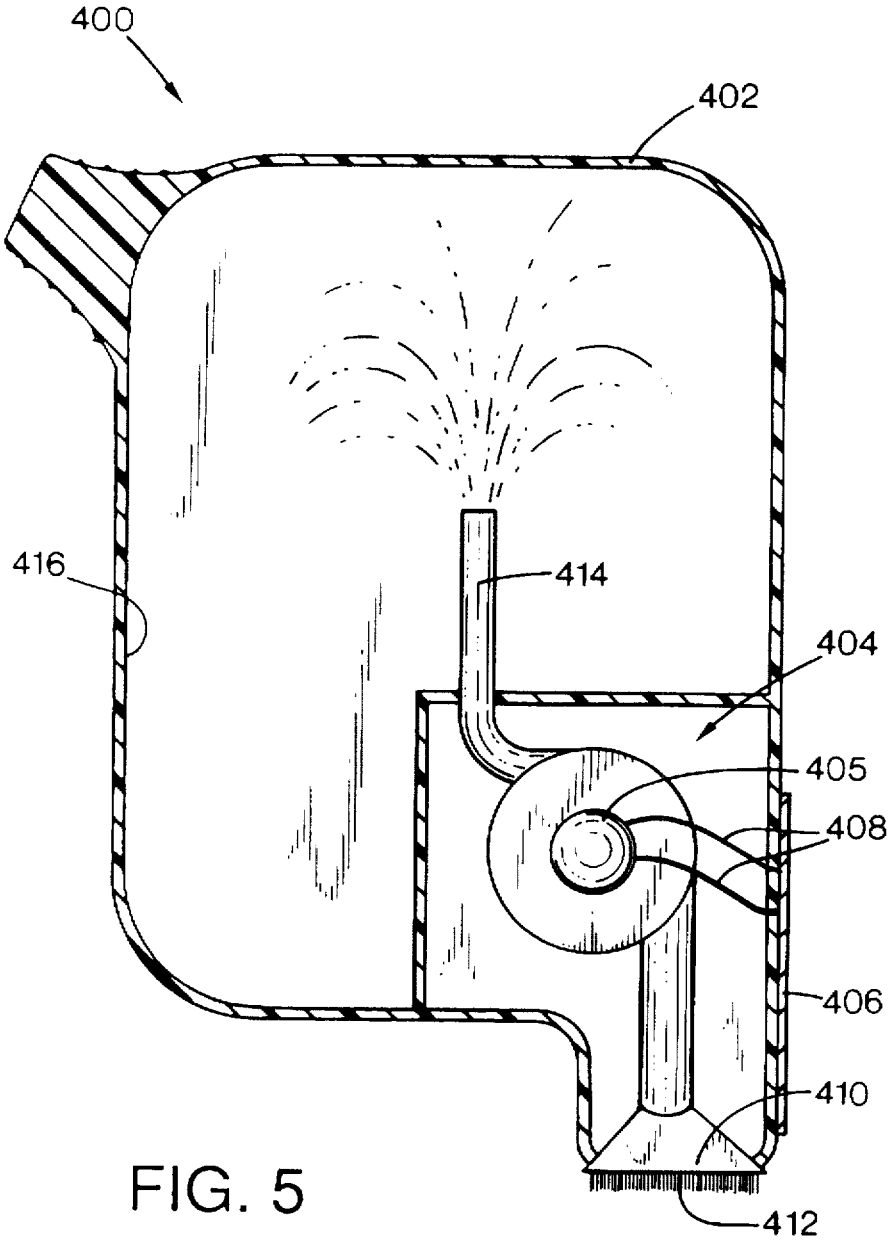
FIG. 5 is a sectional side elevational view of a third embodiment of an inkjet cleaner cartridge of the present invention.

FIG. 5 illustrates another embodiment of a cleaner cartridge 400 constructed in accordance with the present invention. The illustrated cartridge 400 is shown as having a body 402, similar to body 102 for use in printer 20. The cartridge 400 has a vacuum system 404 which has a vacuum motor 405 powered by either an on-board battery (not shown) or via power interconnect pulses received through a flextab circuit 406 via conductors 408. The casing 402 defines an inlet port or scoop 410 which may have a series of soft bristles 412 along its exterior surface.

The vacuum motor 405 draws dust and dirt particles from the interior of printer 20 through the inlet 410 and delivers the particles through a connecting conduit 414 into a dust chamber 416 defined by the casing 402. The printer carriage 46 may propel the vacuum cleaner cartridge 400 across the print zone 38 and the service station area 50 to clean and remove particulate matter therefrom. The cartridge 400 may be disposed when full as illustrated, or a cleaning door (not shown) may be provided in the body 402 to allow emptying of the cartridge when full.

Figure 6:
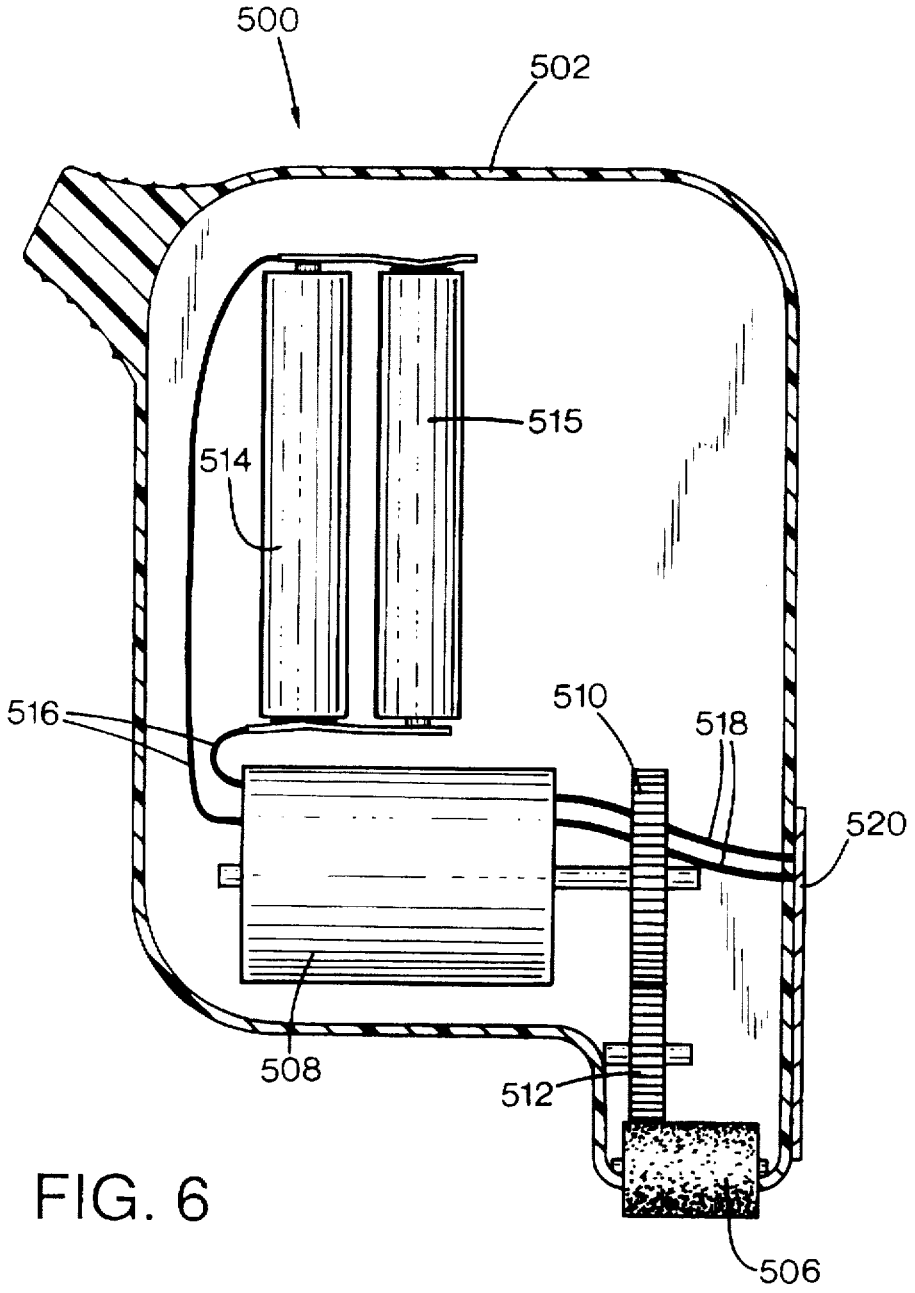
FIG. 6 is a sectional side elevational view of a fourth embodiment of an inkjet cleaner cartridge of the present invention.

FIG. 6 illustrates a cleaner cartridge embodiment 500 having a body 502 designed to be received within printer 20. Sharp edges on the printer wipers 54 with are believed to be more efficient in wiping the printheads, although the wipers may become rounded with use over time. The cartridge 500 may be used to sharpen and rejuvenate the edges of the printer wipers 54. Also, the cartridge 500 may be used to clean or scrape debris from the edges of the printer wipers 54. The printer 20 has the ability to re-index the wiper height to accommodate any loss of wiper height from sharpening or cleaning.

The cartridge 500 has a grit wheel 506 which may either be stationary or pivotally mounted to the casing 502. The wheel 506 extends through an opening in the bottom of the casing. When pivotally mounted, the grit wheel 506 may be driven directly by a motor 508 or through a series of gears 510 and 512. While the motor 508 may be powered through the interconnect, as illustrated above for cartridges 15, 300 and 400 (FIGS. 1, 4 and 5), the illustrated embodiment uses on-board batteries 514 and 515 coupled to the motor by conductors 516. When the sharpening cartridge 500 is positioned over one of the wipers 54, the motor 508 may receive a control signal from the printer 20, via conductors 518 and flextab 520, which causes the motor to rotate wheel 506 and sharpen the wiper tip through abrasive action. If the wheel 506 is mounted in a stationary manner to the casing 502, then the cartridge may be reciprocated by carriage 46 over the tip of each wiper 54 to sharpen and/or clean the wipers.

Figure 7:
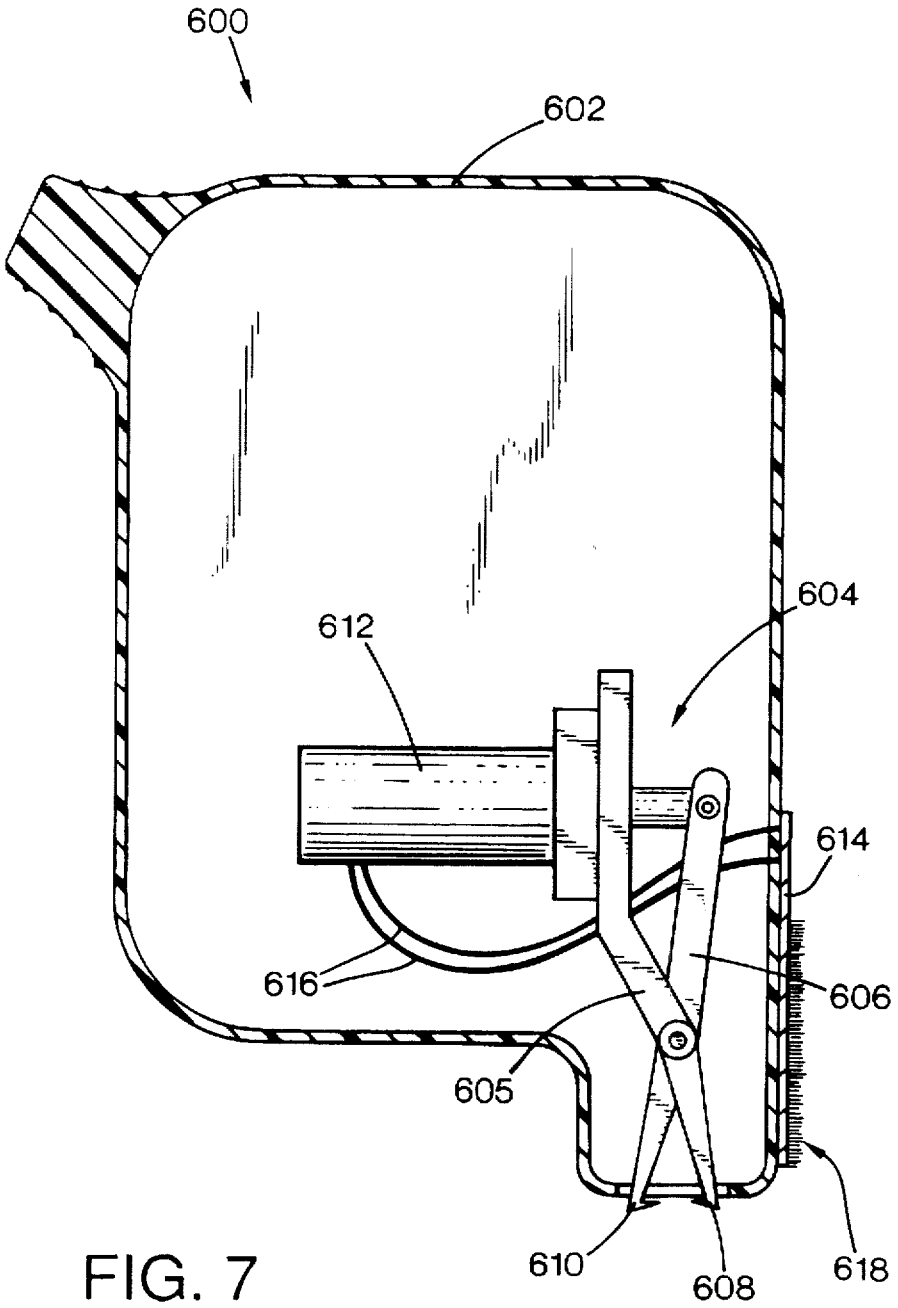
FIG. 7 is a sectional side elevational view of a fifth embodiment of an inkjet cleaner cartridge of the present invention.

FIG. 7 shows an alternate embodiment of a cleaner cartridge 600 constructed in accordance with the present invention for use in sharpening or rejuvenating the edges of wipers 54 in printer 20. Rather than use abrasive action on the wipers, the cleaner cartridge 600 has a body or casing 602 which houses a wiper cutting mechanism or nipper 604. The wiper nipper 604 may have a scissor-like mechanism with two pivotally joined arms 605 and 606 which terminate in jaws 608 and 610, respectively. The jaws 608 and 610 extend through an opening in the casing 602. An actuator device, such as a servomechanism 612 may receive power from the printer 20 via a flextab circuit 614 and conductors 616. When the carriage 46 positions cartridge 600 over a wiper 54, then the printer powers servomechanism 612 to operate to force the jaws 608 and 610 together and remove any rounded portion of the wiper tip between the jaws.

The cleaner cartridge 600 also illustrates another cleaning function, which may be incorporated into any of the other embodiments described herein, or supplied as the sole cleaning feature of a cleaner cartridge. The cartridge 600 includes a pen interconnect cleaning function constructed in accordance with the present invention. The illustrated cartridge flextab 614 is surfaced with an abrasive material, such as a series of bristols 618. The bristols 618 abrasively scrub the printer carriage interconnects (not shown) through a relative wiping motion when the cartridge 600 is installed in printer 20. While the bristols 618 are shown as occupying a relatively large portion of the surface area of the flextab 614, either a smaller portion or the entire area of flextab 614 may be covered with an abrasive material. For example, only the lower portion of the flextab 614 may be covered with the abrasive material, or only the power interconnecting pads may be left uncovered.

Figure 8:
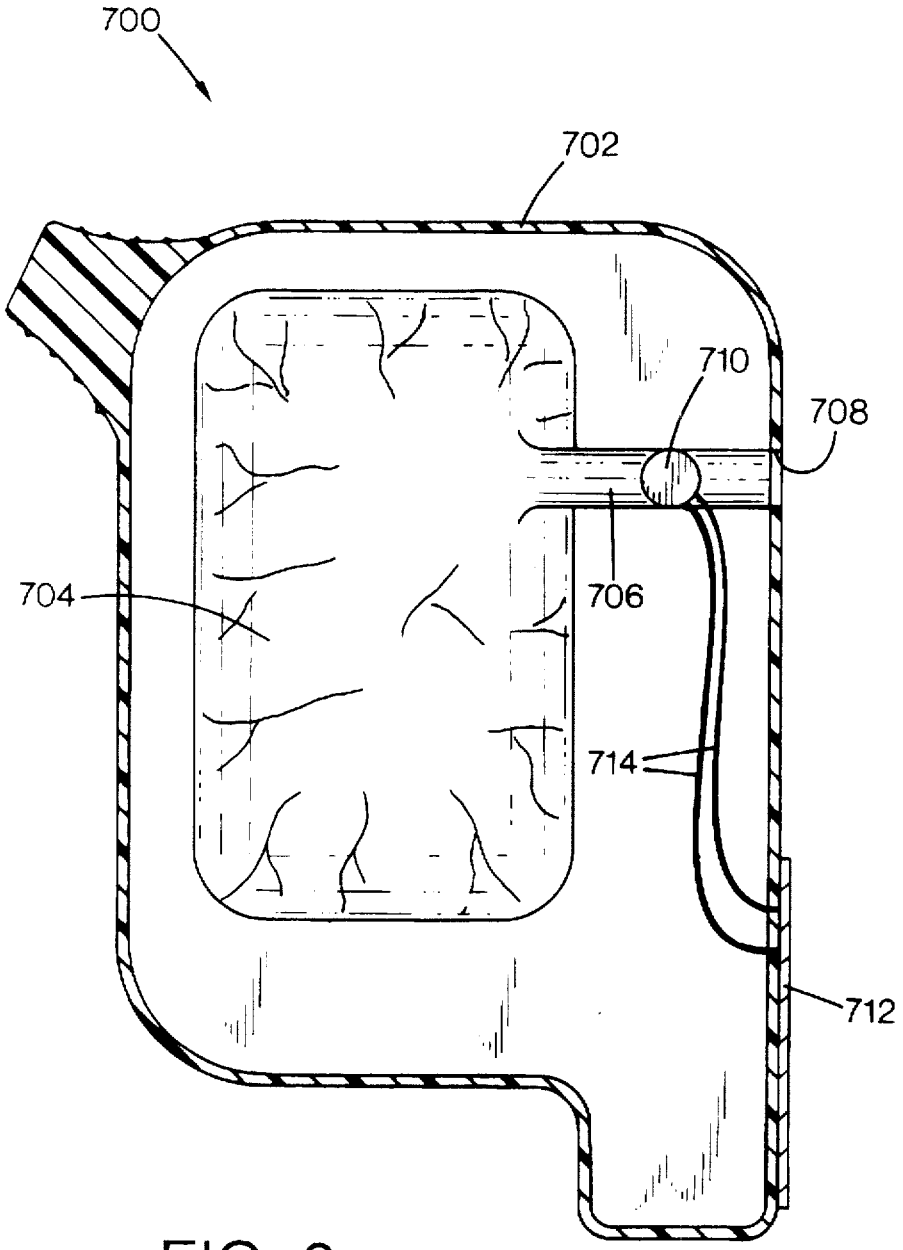
FIG. 8 is a sectional side elevational view of a sixth embodiment of an inkjet cleaner cartridge of the present invention.

FIG. 8 illustrates another embodiment of a cleaner cartridge 700 constructed in accordance with the present invention to flush clogs from the ink lines of a printer. The cleaner cartridge 700 includes a casing or body 702 which has a reservoir 704 housed therein. Preferably, the reservoir 704 is a collapsible bladder supplied to the consumer in a collapsed condition. The reservoir 704 may be coupled via a tube 706 or other fluid passageway to an inlet port 708 defined by body 702. The cartridge 700 has a pumping unit 710 which may be placed in line with the tubing 706. The pump unit may receive power from the printer via a flextab circuit 712 and conductors 714.

Figure 9:
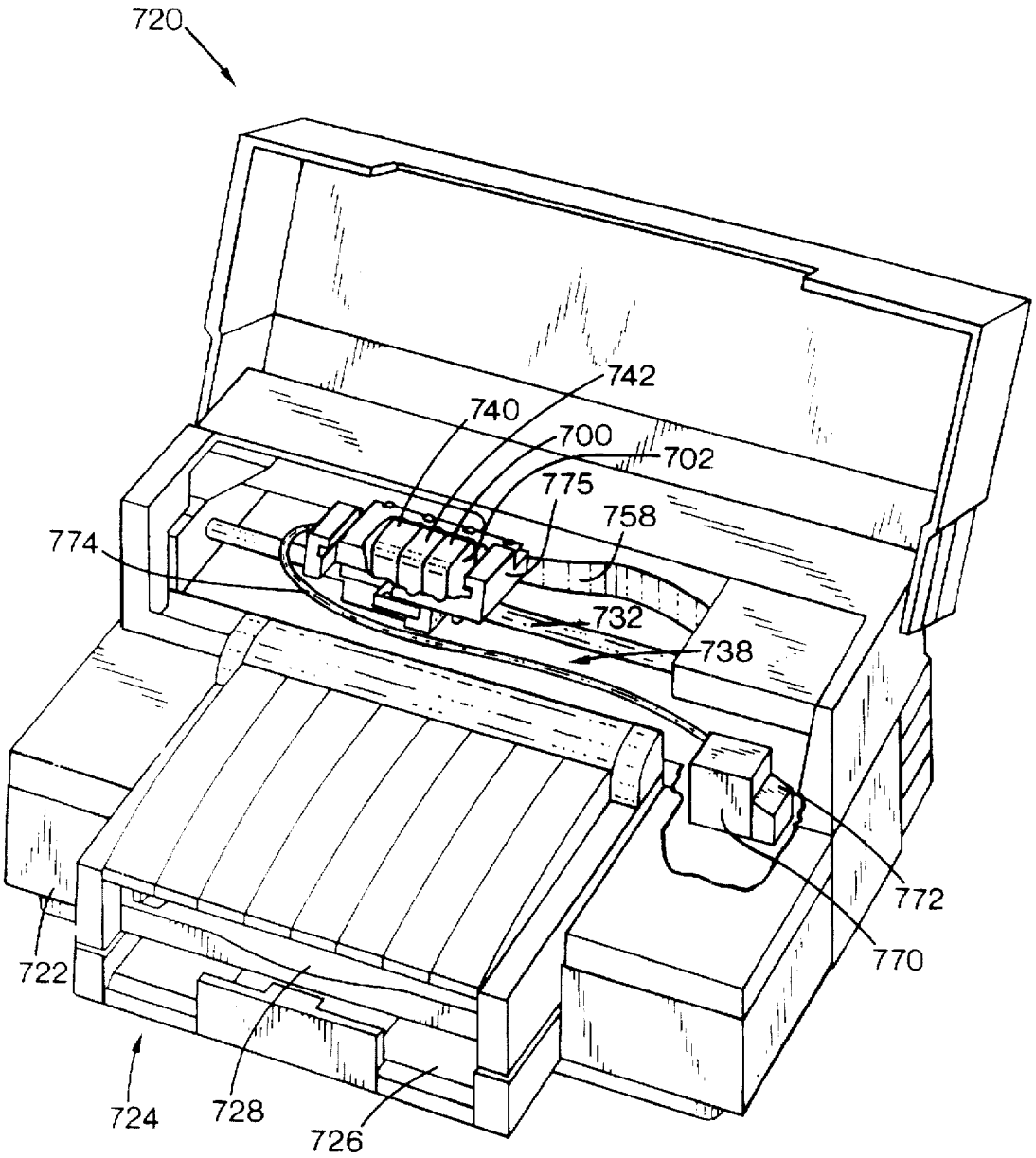
FIG. 9 is a perspective view of a third embodiment of an inkjet printing mechanism used to illustrate several operational characteristics of the illustrated forms of the inkjet cleaner cartridge of the present invention.

The cleaner cartridge 700 may be used with an off-axis ink storage printer, such as printer 720 shown in FIG. 9. Various components of printer 720 are similar in function to those described above with respect to printers 20 and 220, and have item numbers increased by 700 from those shown in FIG. 2, and by 500 from those shown in FIG. 3. For example, the flex conduit strip carrying the control signals is assigned item number 258 in FIG. 3, whereas the flex conduit strip having a similar function is assigned number 758 in FIG. 9. Similarly, while the chassis in FIG. 2 is labeled item number 22, in FIG. 9 the chassis is assigned item number 722.

The printer 720 varies from printers 20 and 220 in that the ink or colorant agent is not stored within the pens and transported by the carriage, but rather is stored in a reservoir 770 mounted to the printer chassis 722. Ink is propelled from the reservoir 770 by a pump or other device, such as a piston actuator 772. Ink travels from the reservoir 770 through a tubing or conduit system 774 to associated pens of a printhead assembly, such as pens 740, 742 housed within a carriage 775. The cartridge 700 is mounted in the carriage 775 in a location normally occupied by a third pen. While a tri-color, three pen carriage 775 is illustrated, it is apparent that the printer 720 may be designed for either monochrome or four-pen printing. The carriage 775 reciprocates along the guide rod 732, and may be propelled by a conventional drive belt (not shown) or other printer carriage drive system.

One problem that may be encountered with off-axis inkjet printers, such as printer 720, is controlling the diffusion rate of the ink or various components of the ink through the walls of the reservoir 770 and the conduit tubing 774. Over time, this leaching of certain constituents of the ink may lead to ink degradation, which manifests itself in the form of a significant increase in viscosity, and in the worst case, solidification of the ink. The cartridge 700 may be used as a catastrophic disaster recovery device when installed in carriage 775 to purge the ink line 774. In a preferred embodiment, the cleaning cartridge 700 may apply a powerful suction to draw the sludge and any solidified ink through the tubing 774 and into reservoir 704. The sludge could be disposed with the entire cartridge, or only the reservoir 704 may be disposed, with a new reservoir installed for the next use.

Alternatively, the printer ink reservoir 770 may be replaced with a solvent filled reservoir, and the solvent drawn through the tubing by suction action of cartridge 700 to dissolve ink clots in the line 774. In another application, the printer ink reservoir 770 may be replaced with an empty reservoir, and cleaning cartridge 700 may inject a solvent forcefully through the conduit 774 in a back-flushing action into the empty reservoir.

Thus, a variety of advantages may be obtained using the various forms of a cleaner or replenishing cartridge 15, 115, 300, 400, 500, 600, and 700 as described herein. In use, a method of cleaning an inkjet printing mechanism is also disclosed. In a replacing step, an inkjet pen within the printing mechanism is replaced by cleaner cartridge 15, 115, 300, 400, 500, 600, and 700. In a positioning step, the cleaner cartridge is positioned over or adjacent to a location of the printing mechanism to be cleaned. In a powering step, power is applied to the cartridge either by coupling an on-board battery via a signal from the carriage interconnect, or through pulses applied through the interconnect to a metering device on-board the cartridge. The metering device may be either a pump or valve for dispensing a fluid or extracting ink sludge from the printer's ink lines, a vacuum pump motor for applying a vacuum suction force to draw particles into the cartridge, or a motor used to propel a strip of cleaning media across the area to be cleaned.

Various modifications may be made to the illustrated embodiments, such as the use of an on-board controller or sensor (not shown), for example, to determine if the wipers 54 have rounded worn edges in need of nipping by cartridge 600. As mentioned above, power for the illustrated cleaner cartridges may be provided through the pen interconnects or through on-board batteries, or other coupling mechanisms. Also, while various passageways have been described as being formed by conduits or tubing, such as conduit 106 in FIG. 1, it is apparent that these passageways may be formed by channels defined by the cartridge casings.

Advantageously, using the cartridges of the present invention, various accumulations of dirt, grit, and solidified ink, may be cleaned and removed from the printer. In other embodiments, various printer components may be refurbished using the cartridges, such as the refilling of an ink solvent reservoir for use with the service station, or the sharpening of wiper edges in the service station. In this manner, a printer may be refurbished, cleansed and replenished to improve print quality and restore the operation of the printer to near-new condition.

I claim:

1. A cleaning cartridge for servicing an inkjet printing mechanism having a pen carriage that removably receives an inkjet pen which includes ink-ejecting nozzles for printing, comprising:

a body configured to be removably received in the pen carriage when the inkjet pen has been removed from the pen carriage;

an apparatus housed in the body and configured to perform a maintenance task on one or more components of the inkjet printing mechanism, wherein the apparatus includes a reservoir, a conduit that fluidically couples the reservoir to an exterior surface of the body, and a metering device that controls fluid flow from the reservoir; and a fluid contained within the reservoir, wherein the fluid comprises a lubricant selected to lubricate moving components of the inkjet printing mechanism.

2. A cleaning cartridge according to claim 1 wherein the lubricant comprises an oil.

3. A cleaning cartridge for servicing an inkjet printing mechanism having a pen carriage, comprising:

a body configured to be removably received in the pen carriage;

an apparatus housed in the body and configured to perform a maintenance task on one or more components of the inkjet printing mechanism, wherein the apparatus includes a reservoir, a fluid contained in the reservoir, and a conduit that fluidically couples the reservoir to an exterior surface of the body; and a flextab circuit supported by the body and electrically coupled to the apparatus to receive an electrical signal from the inkjet printing mechanism when the cartridge is received in the pen carriage;

wherein the fluid comprises a lubricant selected to lubricate moving components of the inkjet printing mechanism.

4. A method of cleaning an inkjet printing mechanism having a pen carriage, comprising the steps of:

replacing an inkjet pen within the inkjet printing mechanism with a cleaner cartridge;

positioning the cleaner cartridge over a component of the inkjet printing mechanism to be serviced; and performing a maintenance task on the component using the cleaner cartridge, wherein the performing step comprises moving a first section of a cleaner media mounted in the cleaner cartridge adjacent the components and thereafter, dispensing a second fresh section of the cleaner media.

5. A method according to claim 4 wherein the performing step comprises moving a cleaner media comprising a particle attractant material mounted in the cleaner cartridge adjacent the component to remove any particles therefrom.

6. A method according to claim 4 wherein the performing step comprises moving a cleaner media comprising an absorbent material mounted in the cleaner cartridge adjacent the component to remove any liquids therefrom.

7. A method according to claim 4 wherein the performing step comprises moving a cleaner media adjacent the component, with the cleaner media comprising an abrasive media mounted in the cleaner cartridge.

8. A method according to claim 4 wherein:

the performing step comprises moving a cleaner media adjacent the component, with the cleaner media comprising an alternating combination of first and second types of cleaner media mounted in the cleaner cartridge, with said first section of a cleaner media comprising the first type of cleaner media and said second section comprising the second type of cleaner media; and the method further includes the step of, after the dispensing step, moving the second section of cleaner media adjacent the component.

9. A method according to claim 8 wherein the performing step comprises moving a cleaner media adjacent the component, with the cleaner media further comprising a third type of cleaner media in an alternating combination with the first and second types of cleaner media.

10. A method according to claim 9 wherein the method further includes the steps of, after the step of moving the second section of cleaner media adjacent the component, dispensing a third section of the cleaner media comprising the third type of cleaner media, and thereafter, moving the third section of cleaner media adjacent the component.

11. A method according to claim 9 wherein the first type of media comprises an abrasive material, the second type of media comprises a particle attractant material, and the third type of media comprises a buffing material.

12. A method according to claim 4 wherein:

the performing step comprises moving a cleaner media comprising an alternating combination of abrasive and absorbent areas mounted in the clear cartridge, with said first section of a cleaner media comprising an abrasive area and said second section comprising an absorbent area enhanced with a particle attractant; and the method further includes the step of, after the dispensing step, moving the absorbent area of second section of cleaner media adjacent the component to clean dust generated during the step of moving the abrasive area of the first section adjacent the component.

13. A method of cleaning an inkjet printing mechanism having a pen carriage, comprising the steps of:

replacing an inkjet pen within the inkjet printing mechanism with a cleaner cartridge;

positioning the cleaner cartridge containing a fluid comprising a lubricant over a component of the inkjet printing mechanism to be serviced;

performing a maintenance task on the component using the cleaner cartridge by spraying the lubricant on a moving component; and electrically powering the cleaner cartridge to perform the maintenance task.

14. A method according to claim 13 further including the step of a metering fluid flow during the spraying step.

15. A method according to claim 14 wherein:

the replacing step comprises replacing the inkjet pen with the cleaner cartridge including a flextab circuit electrically coupled to receive an electrical signal from the inkjet printing mechanism at the conclusion of the replacing step; and the metering step comprises the step of receiving the electrical signal from the inkjet printing mechanism and in response thereto, metering said fluid flow.

16. A method according to claim 15 wherein the electrically powering step comprises receiving electrical power from the inkjet printing mechanism through the flextab circuit.

17. A method according to claim 13 wherein:

the replacing step comprises replacing the inkjet pen with the cleaner cartridge including a flextab circuit electrically coupled to receive an electrical power from the inkjet printing mechanism at the conclusion of the replacing step; and the electrically powering step comprises receiving electrical power from the inkjet printing mechanism through the flextab circuit.

* * * * *

UNITED STATES PATENT AND TRADEMARK OFFICE

CERTIFICATE OF CORRECTION

PATENT NO. : 5,754,197

DATED : May 19, 1998

INVENTOR(S) : Alan Shibata

It is certified that error appears in the above-identified patent and that said Letters Patent is hereby corrected as shown below:

Column 3, (line 61), delete "I 10" and insert therefor --110--.

Column 4, (line 18), delete "11I" and insert therefor --111--.

Column 5, (line 38), delete "article" and insert therefor --particle--.

In the Claims

Column 9, (line 30), delete "compo-".

Column 9, (line 31), delete "nents" and insert therefor --component--.

Column 10, (line 14), delete "clear" and insert therefor --cleaner--.

Signed and Sealed this

First Day of December, 1998

*Attest:*

*Attesting Officer*

BRUCE LEHMAN

*Commissioner of Patents and Trademarks*